United States Patent [19]

Misiak et al.

[11] Patent Number: 5,069,382

[45] Date of Patent: Dec. 3, 1991

[54] APPARATUS AND METHOD FOR PRODUCING A PRESSURE VESSEL FROM METAL TUBING

[75] Inventors: Richard J. Misiak, Lakeside; Kenneth J. Miller, Valley Center, both of Calif.

[73] Assignee: Solar Turbines Incorporated, San Diego, Calif.

[21] Appl. No.: 614,801

[22] Filed: Nov. 16, 1990

[51] Int. Cl.[5] ..... B23K 37/02

[52] U.S. Cl. ..... 228/146; 228/48; 228/184

[58] Field of Search ..... 228/173.4, 184, 48, 228/4.1, 183, 146, 17.7, 145, 130; 72/49, 50, 142, 143, 144

[56] References Cited

U.S. PATENT DOCUMENTS

| | | | |
|---|---|---|---|
| 2,216,606 | 10/1940 | Taylor | 228/145 |
| 2,359,446 | 10/1944 | Scudder | 228/184 |
| 3,423,003 | 1/1969 | Fletcher | 228/17.7 |
| 3,549,077 | 12/1970 | Huck | 228/17.7 |
| 3,616,985 | 11/1971 | Koch | 228/4.1 |
| 3,893,324 | 7/1975 | Cappell | 72/144 |
| 3,956,914 | 5/1976 | Prochaska | 228/60 |
| 4,295,592 | 10/1981 | Schafer | 228/48 |
| 4,314,397 | 2/1982 | Goolsby | 228/183 |
| 4,984,360 | 1/1991 | Sather et al. | 72/142 |

*Primary Examiner*—Richard K. Seidel
*Assistant Examiner*—James Miner
*Attorney, Agent, or Firm*—Sterling R. Booth, Jr.; Alan J. Hickman

[57] ABSTRACT

Conventional apparatus for forming pressure vessels from tubing involves a separate step of the forming of the tubing into coils and then separately welding the coils together. The conventional method has proven to be costly because of the type of apparatus required as well as time consuming and frequently producing a poor quality product when the welding is done independent of coiling step. The subject apparatus overcomes these problems by providing a collapsible mandrel to which tubing is wrapped to form coils for a pressure vessel and simultaneously welding the coils together in one step. The coils are guided on the mandrel by a carriage means which is controlled by a hydraulic system to maintain the coils into intimate contact with each other as they are being welded together. A welding torch, also carried by the carriage, is guided by the forming of the coils rather than some guide means to guide the welder independently of this operation. Tension apparatus is provided which also serves as a guide for the tubing as it is being wrapped on the mandrel. The mandrel is collapsible so that its interference with a finished fabricated cylindrical wall can be reduced so the cylindrical wall can be easily removed. A hydraulic system is provided with features that allows a steady operation of the system without any interrupting jumps or jerks in the system which could create a bad weld.

8 Claims, 7 Drawing Sheets

Fig. 1.
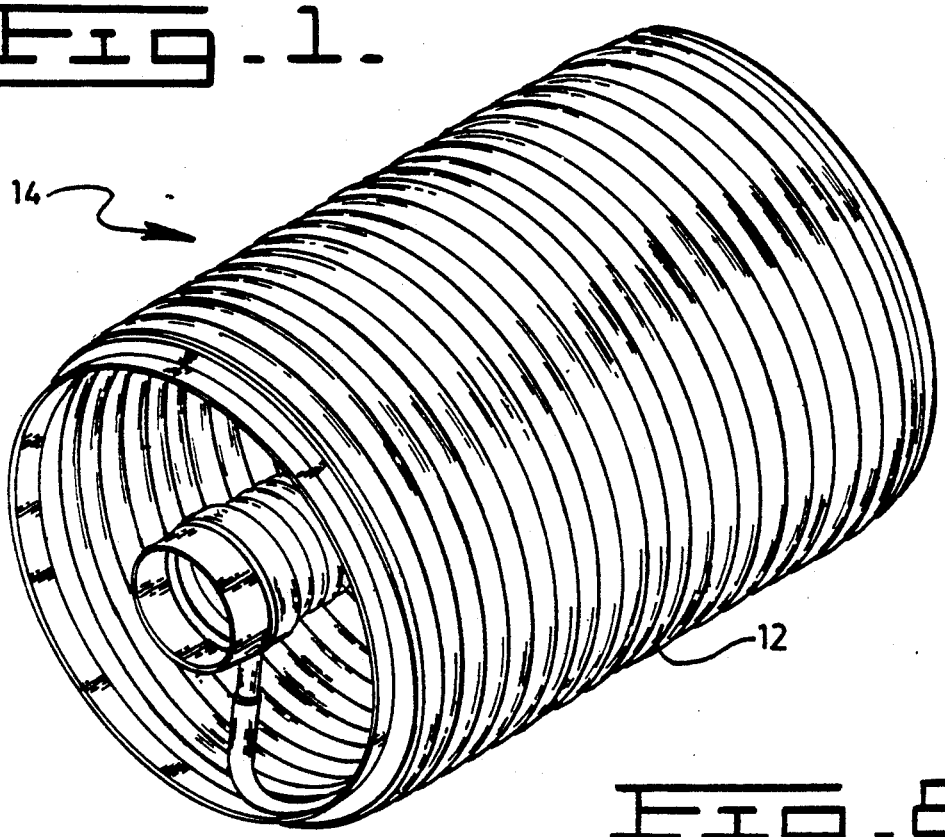
Fig. 8.
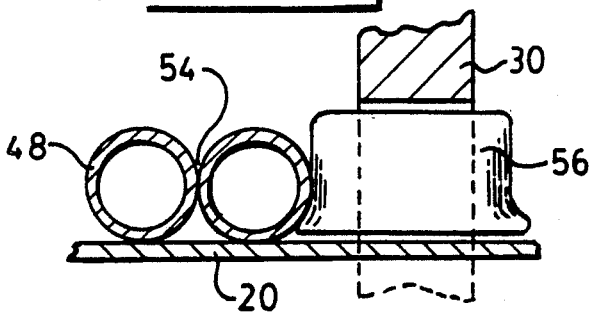
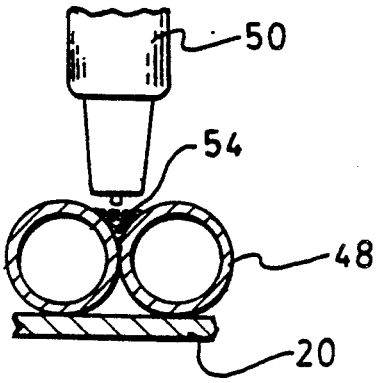
Fig. 7.
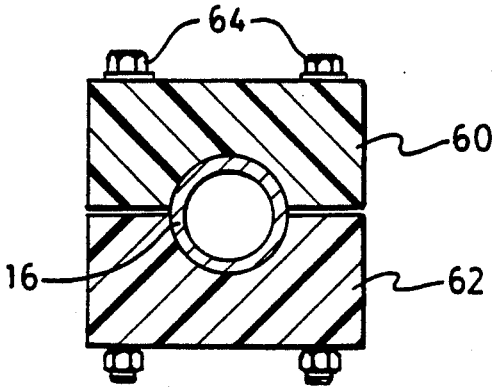
Fig. 9.

APPARATUS AND METHOD FOR PRODUCING A PRESSURE VESSEL FROM METAL TUBING

TECHNICAL FIELD

This invention relates to an apparatus and method for producing a fabricated pressure vessel from metal tubing simultaneously formed and welded around a collapsible mandrel.

BACKGROUND ART

The prior method of manufacturing pressure vessels from tubing involved the process of first wrapping a length of tubing around a solid mandrel forming a number of continuous coils, then allowing the coils to relax so they could be removed from the mandrel. The coiled tube was then remounted on a mandrel with a larger diameter and a welder with a seam tracking device was used to weld the coils together to provide the continuous cylindrical wall for the pressure vessel.

Although the above described process produced the pressure vessel circular wall from tubing, it was difficult to maintain a consistent level of quality required for the circular wall which had to be strong and leak free. When the wrapped coils were removed from the mandrel prior to welding, it was quite difficult to get the adjacent coils to stay in contact with each other to provide the proper environment for the welding of the coils together. Hence a poor quality of weld and joint were produced which would either leak or be weakened by burning too deep into the tubing wall.

The two step operation was time consuming and the seam tracking welding equipment was quite expensive resulting in a rather costly process that was difficult to control.

The present invention is directed to overcoming the problems as set forth above.

DISCLOSURE OF THE INVENTION

In one aspect of the invention, apparatus is provided for producing a fabricated pressure vessel from metal tubing. The metal tubing is coiled and welded into a continuous cylindrical wall to form a pressure vessel. The apparatus includes a cylindrical mandrel rotatably mounted on a machine frame with means on the mandrel for attaching an end of a length of metal tubing to the mandrel. A carriage is reciprocably mounted on ways mounted on the machine frame, said carriage encompassing the mandrel for guiding the metal tubing forming continuous coils around the mandrel. A tension device is secured to the carriage to guide and maintain a tension on the metal tube as it is being wrapped onto the mandrel to form the continuous coils. A welding means is mounted on the carriage to simultaneously weld adjacent coils of the metal tubing together as they are being formed on the mandrel.

In a further aspect of the invention, a hydraulic means is provided for controlling the reciprocable movement of the carriage. The hydraulic means includes a hydraulic cylinder attached to the carriage and secured to the machine frame. The hydraulic cylinder is controlled by a hydraulic system under control of a fluid pressure setting means to cause the carriage to maintain a constant force against the coils as they are being formed on the mandrel. The welding means mounted on the carriage includes a torch having a continuous wire feed. The torch is aimed at the center of an apex formed between adjacent coils to continuously weld the coils together while under tension on the mandrel. A guide roller means is rotatably mounted to the carriage to guide the metal tube as it is being wrapped around the mandrel to form the continuous coils and to hold them together as they are being welded. The mandrel is also collapsible to facilitate removal of the finished fabricated cylindrical wall from the mandrel.

In yet a further aspect of the invention, a method for producing a fabricated pressure vessel from the length of metal tubing is described. The metal tubing is coiled and welded into a continuous cylindrical wall to form a pressure vessel. The method comprises attaching an end of the metal tubing to a cylindrical mandrel, wrapping the metal around the cylindrical mandrel by rotating the cylindrical mandrel and pulling the metal tubing through a tension device to maintain the metal tubing under tension as it is being wrapped around the mandrel. As the metal tubing is being wrapped around the cylindrical mandrel, it is formed into a series of continuous cylindrical coils making an intimate point of contact with each other, and forming an apex between the adjacent coils. A number of said coils determining the pressure vessel's length. As the coils are being formed, they are being welded to each other at the apex between the adjacent coils simultaneously with the wrapping of the cylindrical coils around the rotating cylindrical mandrel. After the cylindrical coils are formed into the cylindrical wall for the pressure vessel and securely welded together, the entire assembly is removed from the cylindrical mandrel by collapsing the mandrel.

BRIEF DESCRIPTION OF THE DRAWINGS

FIG. 1 is a perspective view of a completed pressure vessel.

FIG. 7 is a partial view of a portion of two adjacent coils being welded by the torch.

FIG. 8 is an enlarged partial view showing one of the rollers supported by the carriage making contact with the coils.

FIG. 9 is an enlarged sectional view of the tension device with the tubing being shown therein.

BEST MODE FOR CARRYING OUT THE INVENTION

Figure 2:
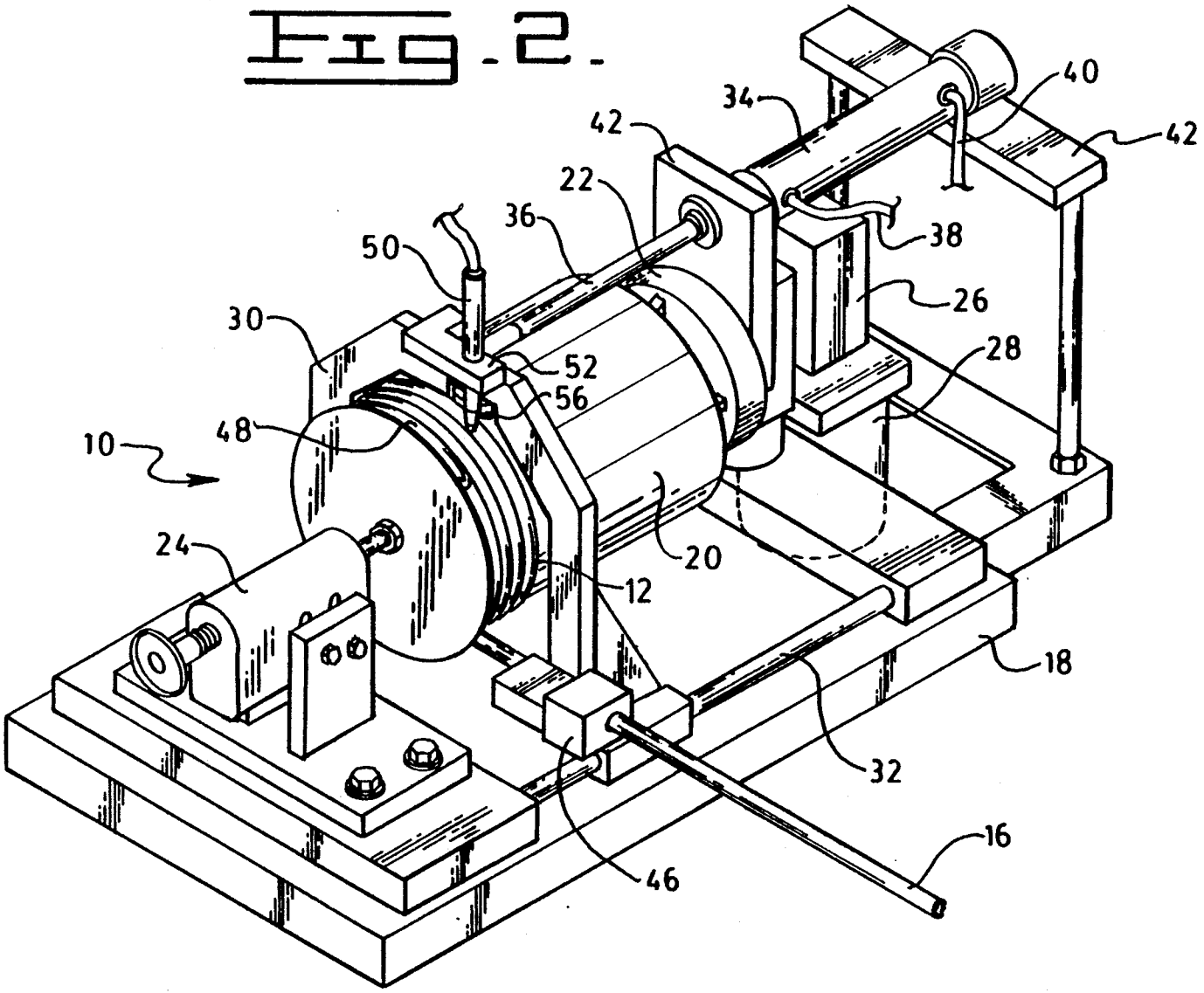
FIG. 2 is perspective view of the apparatus for producing the circular wall from tubing.

In FIG. 2 an apparatus 10 is shown for producing a cylindrical wall 12 for a pressure vessel 14 from a length of tubing 16. The apparatus 10 includes a machine frame 18 which may be mounted on a suitable base or other support not shown. To the apparatus is mounted a mandrel 20 which is supported by a chuck 22 and a tail stock 24 which are in turn mounted to the frame 18.

The mandrel 20 is driven by a gear reduction 26 powered by an electric motor 28.

Figure 10:
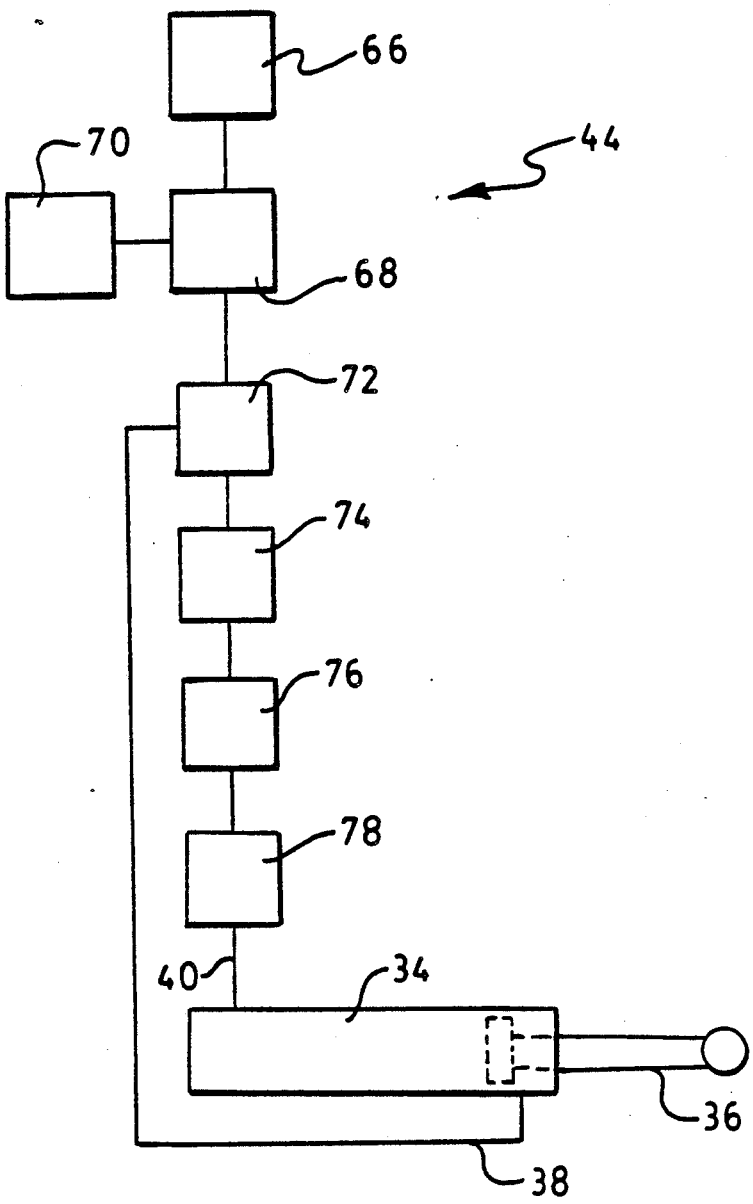
FIG. 10 is a schematic of the hydraulic circuit for controlling the carriage.
Figure 11:
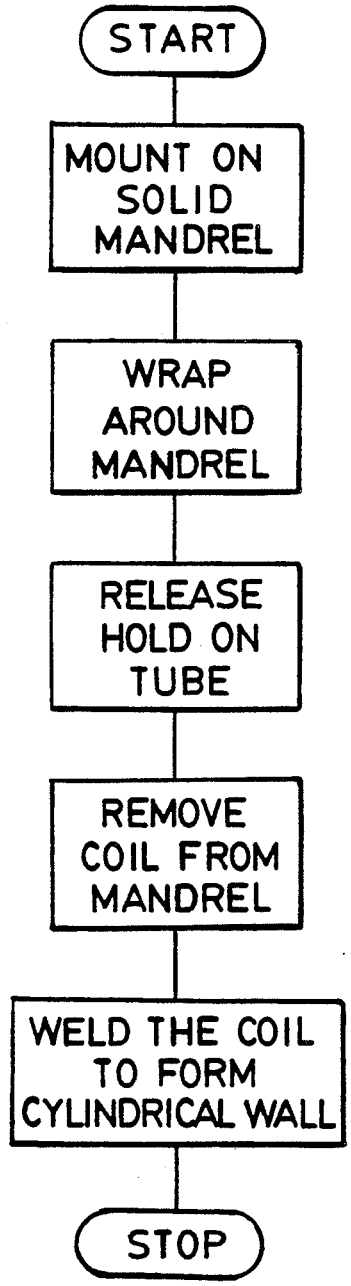
FIG. 11 is a processing flow diagram for the prior art method.
Figure 12:
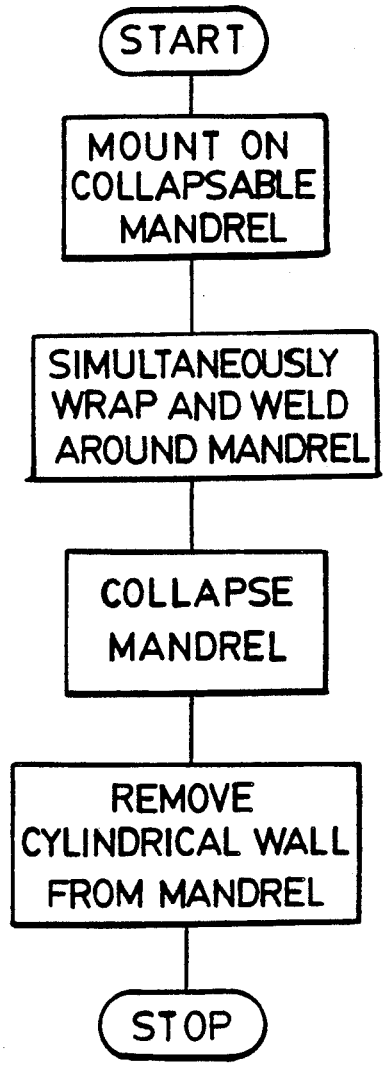
FIG. 12 is a processing flow diagram for the invention.

A carriage 30 is mounted on a pair of ways 32 which in turn are also secured to the frame 18. The carriage 30 which is in a "U" shape encompasses the mandrel 20 such that it surrounds the mandrel 20 on its upper side. Attached to the carriage is a hydraulic cylinder 34 having a rod 36 and hydraulic lines 38 and 40. The cylinder 34 is secured to the frame 18 by bracket 42. The hydraulic lines 38,40 in turn are connected to a hydraulic control system 44 which is schematically shown in FIG. 10 and will be described later.

A tension device 46 is mounted on the carriage 30. The tension device 46 consists of a split block of bearing material such as delrin polic propoline to engage the tubing 16.

Figure 3:
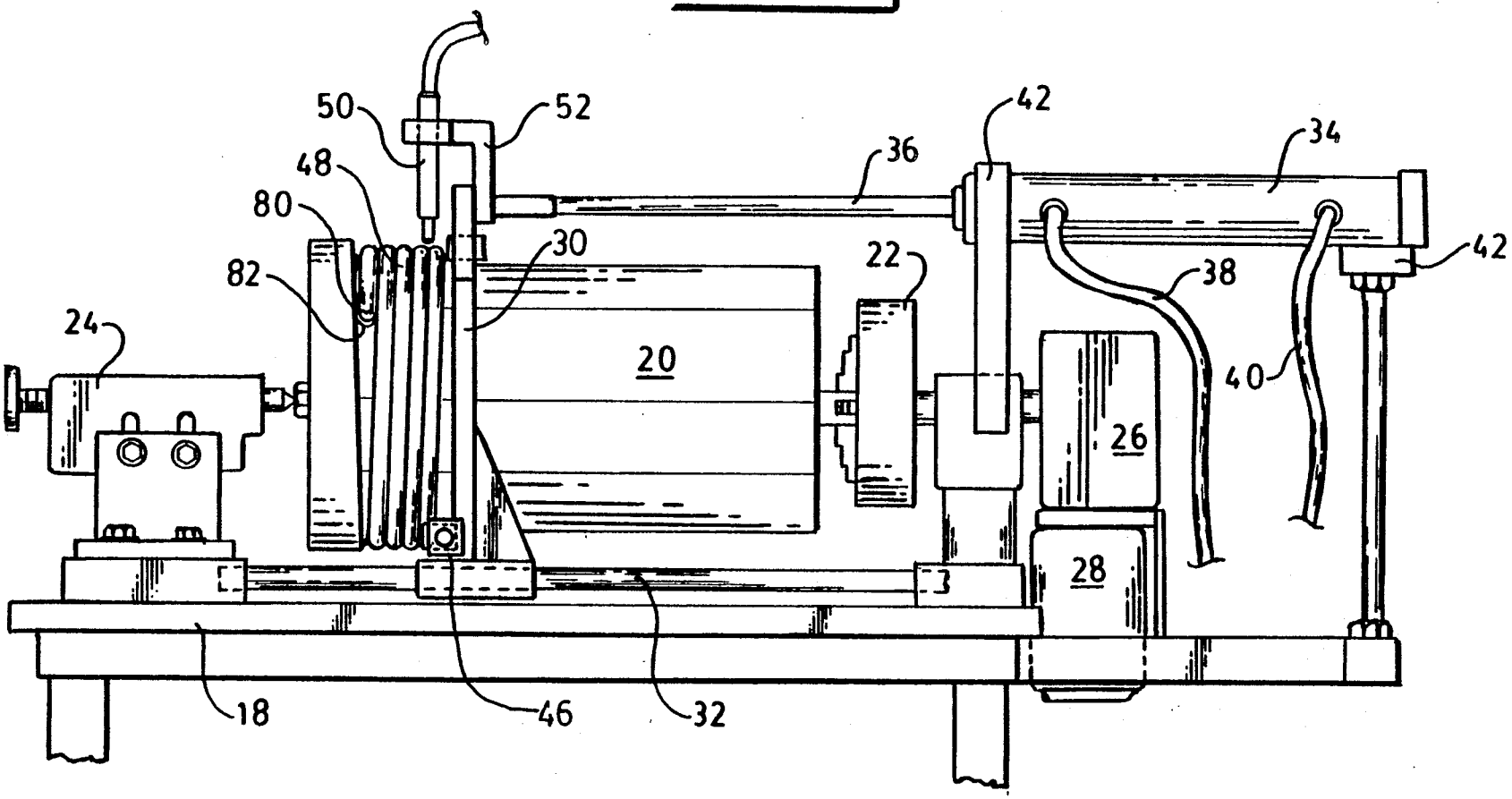
FIG. 3 is a side elevational view of the apparatus.
Figure 4:
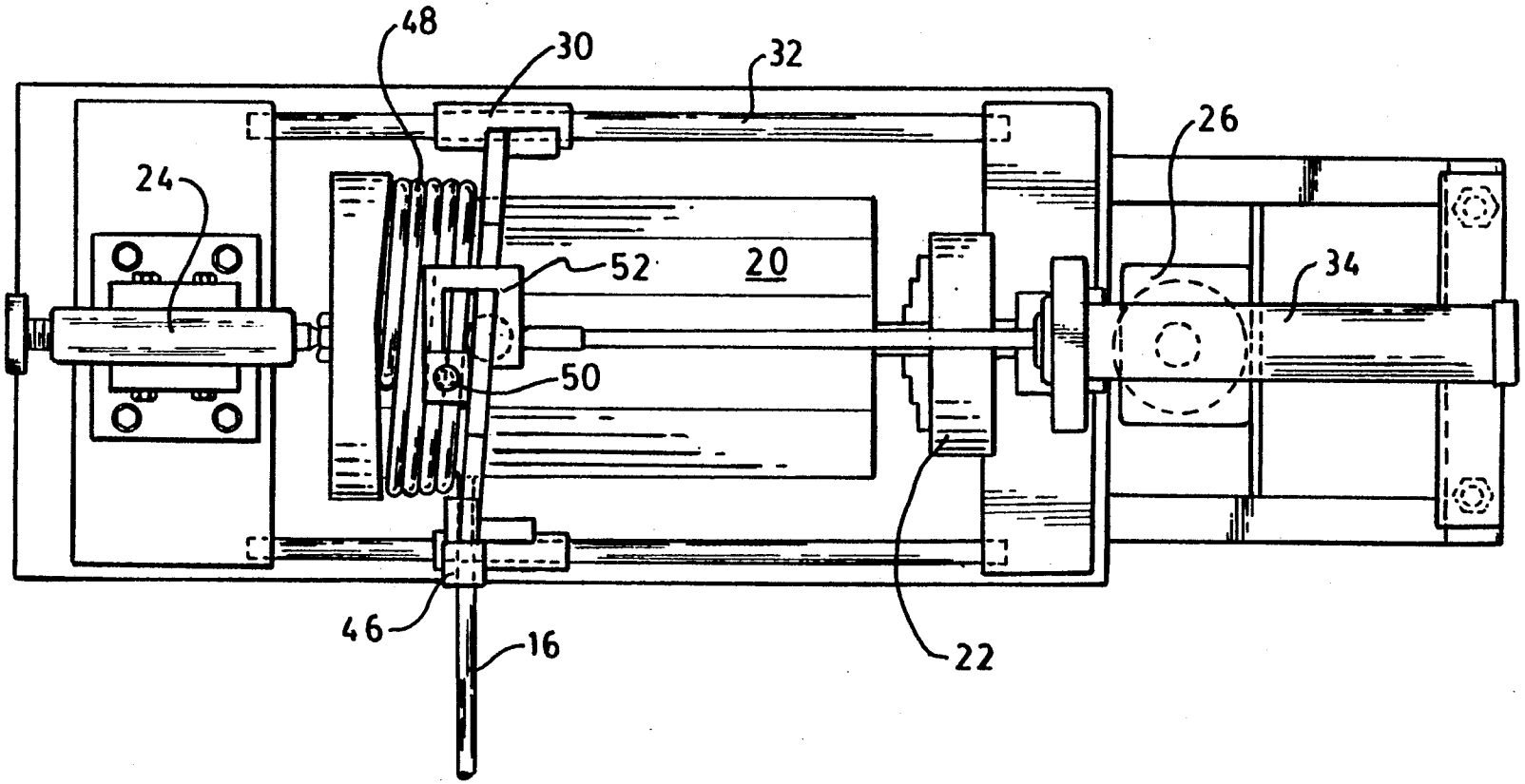
FIG. 4 is plan view of the apparatus.
Figure 5:
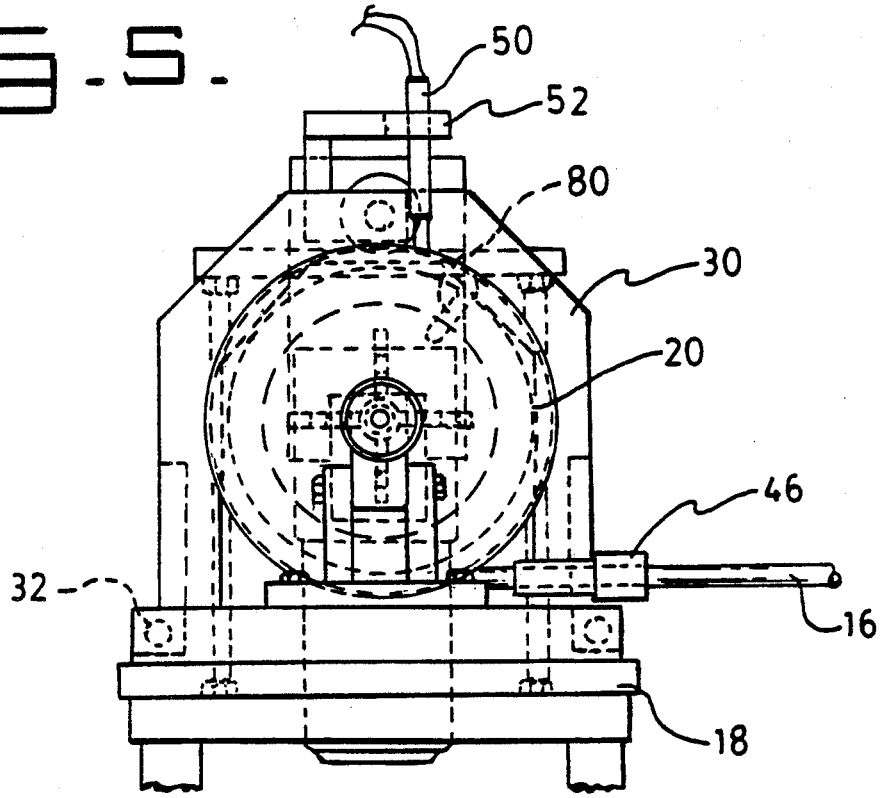
FIG. 5 is an end view of the apparatus.

The tubing 16 is shown partially wrapped into coils 48 on the mandrel 20 and by referring to FIGS. 3 and 4 the arrangement of the tubing 16 on the mandrel 20 can be more readily seen.

The mandrel 20 consists of eight segments which are of equal dimension so that the mandrel can be collapsed to reduce the interference between it and the finished cylindrical wall 12. Other types of mandrels that are collapsible could be used in this application.

Figure 6:
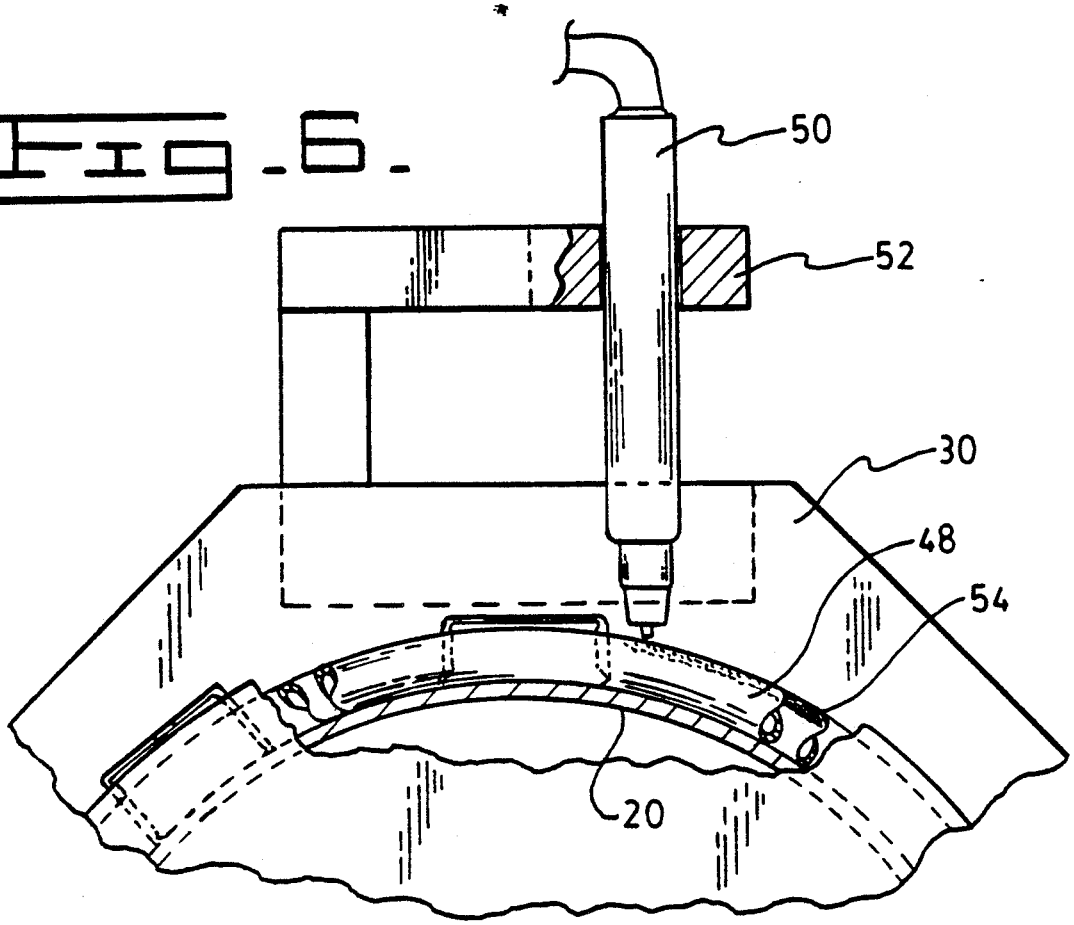
FIG. 6 is an enlarged partial view of the apparatus showing the location of the welding torch in relationship to the mandrel and coils.

As is more clearly shown in FIG. 6, a welding torch 50 is mounted in a bracket 52 which is in turn secured to the carriage 30. As shown in this particular welding sequence, the torch 50 engages an apex 54 between two adjacent coils 48 slightly to one side of the center line of the collapsible mandrel. It is envisioned that on different types of tubing the torch 50 may be adjusted to different positions with respect to the centerline of the mandrel 20. It could also be set to the left of the centerline or at an angle to the centerline of the mandrel 20.

The carriage 30 contains rollers 56 and 58 to rotate against the lead coil of the cylindrical wall being fabricated on the mandrel. One of these rollers is shown in FIG. 8 running against the coils 48 of tubing 16 to maintain them into intimate contact at a point on their periphery to form the apex 54. As can be see in FIG. 7, the torch 50 will place the weld directly in the center of the apex 50 so as to provide substantially equal penetration of the welding material into the wall of each adjacent coil.

The tension device 46 which is mounted on the carriage 30 guides and maintains a tension on the tubing 16 as it is being wrapped onto the mandrel 20. The tension device 46 is made of a bearing type material clamped at sufficient force on the tubing to provide the friction required to produce the desired tension. In this particular aspect of the invention, the tension device 46 consists of two blocks of material 60 and 62 which are clamped together by fastening means 64.

The hydraulic control system 44 which controls the movement of the hydraulic cylinder 34 includes a hydraulic reservoir 66 and a pump 68 driven by an electric motor 70. The pump pressure is controlled by a first pressure setting valve 72 which is set at approximately 200 psi. The fluid at this pressure is directed to a second pressure setting valve 74 which sets the pressure at approximately 76 psi which is then directed to a directional control valve 76. The control valve is then controlled by the machine operator to cause the piston to move in the direction required to control the carriage. A third pressure setting valve 78 sets the pressure at approximately 75 psi to a head end of the hydraulic cylinder 34.

As the tubing is being wrapped onto the collapsible mandrel 20, the force of the hydraulic cylinder 34 is used to hold the carriage 30 against the tubing so as to hold the coils 48 securely in contact with each other as they are being formed on the mandrel 20 to provide a superior joint.

The welding torch 50 used in this application is fed by a continuous wire feeding welder such as a TIG or an MIG welder to provide a continuous uninterrupted weld joint. Other welding means could be adapted to this particular application.

Industrial Applicability

In operation the apparatus 10 would be set in the factory and a table (not shown) would be provided to support the lengths of tubing 16 required to produce a particular size of cylindrical wall 12 for the pressure vessel 14. The diameter of the pressure vessel is determined by different diameter mandrels and its length by the number of coils 48. To begin the operation, the tubing 16 would be provided with a hook 80 or other means attached to its end which is then attached to an attachment means 82 on the mandrel 20. The tubing 16 would then be clamped in the tension device 46 and the mandrel 20 would begin to rotate. As the mandrel 20 rotates, the tubing 16 would then be formed into the coils 48 as it is being wrapped onto the mandrel 20. The hydraulic control system 44 would then be actuated to cause the carriage 30 to maintain a force against the coils 48 as they are being wrapped onto the mandrel 20. As the second coil is being formed onto the mandrel 20 against the first coil, the welding operation would take effect simultaneously securing the two adjacent coils together at the apex 54. This operation would continue until the desired length of cylindrical wall 12 required for a particular pressure vessel is achieved. At that time the operation would shut off and the carriage 30 would be removed from the coils. The mandrel 20 would then be collapsed and the finished fabricated cylindrical wall 12 removed from the collapsed mandrel. A perspective view of the completed pressure vessel 14 is shown in FIG. 1.

Other aspects, objects, and advantages become apparent from study of the specification, drawings, and appended claims.

We claim:

1. An apparatus for producing a fabricated pressure vessel from a length of metal tubing, said metal tubing being coiled and welded into a continuous cylindrical wall of the pressure vessel, said apparatus comprising:

a machine frame;

a plurality of ways mounted on said machine frame;

a cylindrical mandrel rotatively mounted on the machine frame;

attachment means for attaching an end portion of the metal tubing to the mandrel;

a carriage connected to said ways and encompassing the mandrel, said carriage being movable along said ways and adapted to guide the metal tube to form continuous adjacent coils around the mandrel;

a tension device mounted on the carriage and engageable with the metal tube, said tension device maintaining a tension on the metal tube and urging the tube into contact with the mandrel during forming of the coil about the mandrel; and welding means for simultaneously joining adjacent coils of the metal tubing together at an apex between the abutting coils of said tubing during winding of said coils on said mandrel, said welding means being connected to and movable with said carriage.

2. The apparatus as set forth in claim 1, including a hydraulic means for controlling the movement of the carriage along said ways.

3. The apparatus as set forth in claim 2, wherein the hydraulic means includes:

a hydraulic cylinder connected to the carriage and the machine frame;

a hydraulic control system connected to the hydraulic cylinder and being adapted to deliver fluid under pressure to said hydraulic cylinder and control the position of the carriage along the ways; and pressure setting means for regulating the pressure of the fluid delivered to said hydraulic cylinder and maintaining a constant force between the carriage and adjacent coils in a direction axially relative to the mandrel.

4. The apparatus as set forth in claim 1, wherein said apex has a center and the welding means mounted on the carriage includes a torch having a continuous wire feed, said torch being aimed at the center of the apex formed between adjacent coils and continuously welding the coils together while under tension on the mandrel.

5. The apparatus as set forth in claim 4, including a guide roller rotatively mounted to the carriage, said guide roller engaging the metal tube and guiding the metal tube during wrapping of the metal tube around the mandrel to form the continuous coils and holding the coils together during welding of the adjacent coils.

6. The apparatus of claim 4, wherein the mandrel is collapsible in a radial direction relative to the axis of the mandrel to facilitate removal of the finished fabricated cylindrical wall from the mandrel.

7. A method for producing a fabricated continuous cylindrical wall of a pressure vessel from a length of metal tubing, said metal tubing being coiled and welded into the continuous cylindrical wall, said method comprising:

attaching an end portion of the metal tubing to a cylindrical mandrel;

rotating the cylindrical mandrel about a longitudinal axis of the cylindrical mandrel and wrapping the metal tubing around the cylindrical mandrel into a series of cylindrical coils;

pulling the metal tubing through a tension device to maintain the metal tubing in tension as it is being wrapped around the cylindrical mandrel;

urging the metal tubing in a direction substantially axially relative to the mandrel to maintain the adjacent formed coils in contact with each other, said adjacent contacting coils defining an apex therebetween;

welding the cylindrical coils to each other at the apex between adjacent coils simultaneously with the wrapping of the cylindrical coils around the rotating cylindrical mandrel; and removing the fabricated cylindrical wall from the cylindrical mandrel.

8. The method as set forth in claim 7, wherein removing the fabricated cylindrical wall from the cylindrical mandrel includes collapsing the cylindrical mandrel to relieve contact between the cylindrical mandrel and the finished continuous cylindrical wall.

* * * * *